US007722472B2

(12) United States Patent
Cameron et al.

(10) Patent No.: US 7,722,472 B2
(45) Date of Patent: May 25, 2010

(54) BILLIARDS STROKE TRAINING DEVICE

(76) Inventors: Chris Cameron, 430 26th Ave. S., Seattle, WA (US) 98144; Anah Cameron, 430 26th Ave. S., Seattle, WA (US) 98144

( * ) Notice: Subject to any disclaimer, the term of this patent is extended or adjusted under 35 U.S.C. 154(b) by 0 days.

(21) Appl. No.: 12/351,252

(22) Filed: Jan. 9, 2009

(65) Prior Publication Data

US 2009/0186712 A1 Jul. 23, 2009

Related U.S. Application Data

(60) Provisional application No. 61/021,832, filed on Jan. 17, 2008.

(51) Int. Cl.
*A63D 15/00* (2006.01)

(52) U.S. Cl. ..... 473/2; 473/450; D21/782

(58) Field of Classification Search ..... 473/422, 473/450, 458, 464, 2, 59, 212, 215
See application file for complete search history.

(56) References Cited

U.S. PATENT DOCUMENTS

| | | | | | |
|---|---|---|---|---|---|
| 2,773,691 | A | * | 12/1956 | Redfield | 473/212 |
| 2,809,043 | A | * | 10/1957 | Brouwer | 473/212 |
| 3,419,277 | A | * | 12/1968 | Martin | 473/214 |
| 3,947,026 | A | | 3/1976 | Scoutten | |
| 3,993,305 | A | | 11/1976 | Nicholson | |
| 4,053,153 | A | | 10/1977 | Josenhans | |
| 4,120,494 | A | | 10/1978 | Roe | |
| 4,579,341 | A | * | 4/1986 | Furr | 473/450 |
| 4,984,789 | A | * | 1/1991 | Socci | 473/458 |
| 5,520,581 | A | | 5/1996 | Mazzoli | |
| 5,716,283 | A | | 2/1998 | Simpson | |
| 6,132,319 | A | | 10/2000 | Schluter | |
| 6,267,686 | B1 | | 7/2001 | Legacie | |
| 6,645,093 | B2 | * | 11/2003 | Sheppard | 473/450 |
| 6,761,643 | B2 | | 7/2004 | Boatwright | |
| 7,118,486 | B2 | | 10/2006 | Evers | |
| 7,147,566 | B2 | | 12/2006 | Keating | |
| 2003/0232658 | A1 | | 12/2003 | Reeves | |
| 2003/0232669 | A1 | * | 12/2003 | Smith et al. | 473/458 |
| 2004/0005932 | A1 | | 1/2004 | Kuo | |
| 2005/0064946 | A1 | | 3/2005 | Cianflone | |
| 2005/0101395 | A1 | | 5/2005 | Keating | |
| 2006/0166752 | A1 | | 7/2006 | Black | |
| 2007/0079421 | A1 | | 4/2007 | Davis | |

* cited by examiner

*Primary Examiner*—Mitra Aryanpour
(74) *Attorney, Agent, or Firm*—Dean A. Craine

(57) ABSTRACT

This invention relates generally to billiards, and more specifically, to systems and methods for providing a billiards stroke training device. In one embodiment, the invention includes a harness, a sleeve, a guide, the guide being coupled to the sleeve; and a post, the post being coupled to the harness, the post being configurable to limit motion of the guide, wherein the harness is configurable to being worn on an upper torso of a billiards player, wherein the sleeve is configurable to being worn on an arm of the billiards player, and wherein motion of the arm of the billiards player is limited to that provided for by the guide.

3 Claims, 4 Drawing Sheets

BILLIARDS STROKE TRAINING DEVICE

PRIORITY CLAIM

This application claims the benefit of U.S. provisional patent application Ser. No. 61/021,832 filed Jan. 17, 2008 (our ref. CMRN-1-1001). The foregoing application is incorporated by reference in its entirety as if fully set forth herein.

FIELD OF THE INVENTION

This invention relates generally to billiards, and more specifically, to systems and methods for providing a billiards stroke training device.

BACKGROUND

Billiards refers to a family of games that are played on a billiard table using a plurality of balls and a cue. Eight-ball is one of the most common billiard games and is played using a single cue ball and fifteen object balls on a table having six pockets. Of the fifteen object balls there is a single black eight ball, seven solid-colored balls, and seven striped balls. To begin the game, the object balls are placed in triangular arrangement on one end of the table and the cue ball is placed on the opposing end (aka "the kitchen"). The game generally progresses with at least two players taking alternating turns using the cue to strike the cue ball against the object balls in an effort to pocket certain object balls. The game concludes when one player pockets all the commonly colored balls and the eight ball before another player pockets all the oppositely colored balls and the eight ball.

There are many other billiard games in addition to eight-ball including nine-ball, straight pool, and one-pocket. Although the rules may be different between them, the ability to use a cue to accurately and precisely strike a cue ball as desired is a common skill required in every billiard game. Accordingly, there have been many inventions conceived to help individuals develop this skill. For instance, there are a number of inventions directed towards improving aiming and sighting skills of a player including Roe (U.S. Pat. No. 4,120,494); Mazzoli (U.S. Pat. No. 5,520,581); Boatwright (U.S. Pat. No. 6,761,643); Evers (U.S. Pat. No. 7,118,486); Keating (U.S. Pat. No. 7,147,566); Reeves (U.S. Pat. Pub. 2003/0232658); Black (U.S. Pat. Pub. 2006/0166752); Keating (U.S. Pat. Pub. 2005/0101395); Kuo (U.S. Pat. Pub. 2004/0005932); Scoutten (U.S. Pat. No. 3,947,026); Nicholson (U.S. Pat. No. 3,993,305); Cianflone (U.S. Pat. Pub. 2005/0064946); and Simpson (U.S. Pat. No. 5,716,283). Further, there are inventions directed towards improving cue contact with a cue ball including Legacie (U.S. Pat. No. 6,267,686) and Schluter (U.S. Pat. No. 6,132,319). There are yet other inventions directed towards training a player to form a proper bridge for supporting the cue including Josenhans (U.S. Pat No. 4,053,153) and Davis (U.S. Pat. Pub. 2007/0079421).

Indeed, aiming, sighting, cue contact, and proper bridging are each important in billiards. However, proper cue stroke technique, including arm positioning, alignment, and motion, forms the foundation for each of the above and ultimately drives the ability to accurately and precisely use a cue to strike a cue ball as desired. Despite its importance, however, the art has thus far neglected assisting players to develop a proper cue stroke, thereby facilitating poor technique and making billiards more difficult than necessary to learn. Therefore, although desirable results have been achieved there exists much room for improvement. What is needed then are systems and methods for providing a billiards stroke training device.

SUMMARY

This invention relates generally to billiards, and more specifically, to systems and methods for providing a billiards stroke training device. In one embodiment, the invention includes a harness, a sleeve, a guide, the guide being coupled to the sleeve; and a post, the post being coupled to the harness, the post being configurable to limit motion of the guide, wherein the harness is configurable to being worn on an upper torso of a billiards player, wherein the sleeve is configurable to being worn on an arm of the billiards player, and wherein motion of the arm of the billiards player is limited to that provided for by the guide.

BRIEF DESCRIPTION OF THE DRAWINGS

Embodiments of the present invention are described in detail below with reference to the following drawings.

DETAILED DESCRIPTION

This invention relates generally to billiards, and more specifically, to systems and methods for providing a billiards stroke training device. Specific details of certain embodiments of the invention are set forth in the following description and in FIGS. 1-4 to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1:
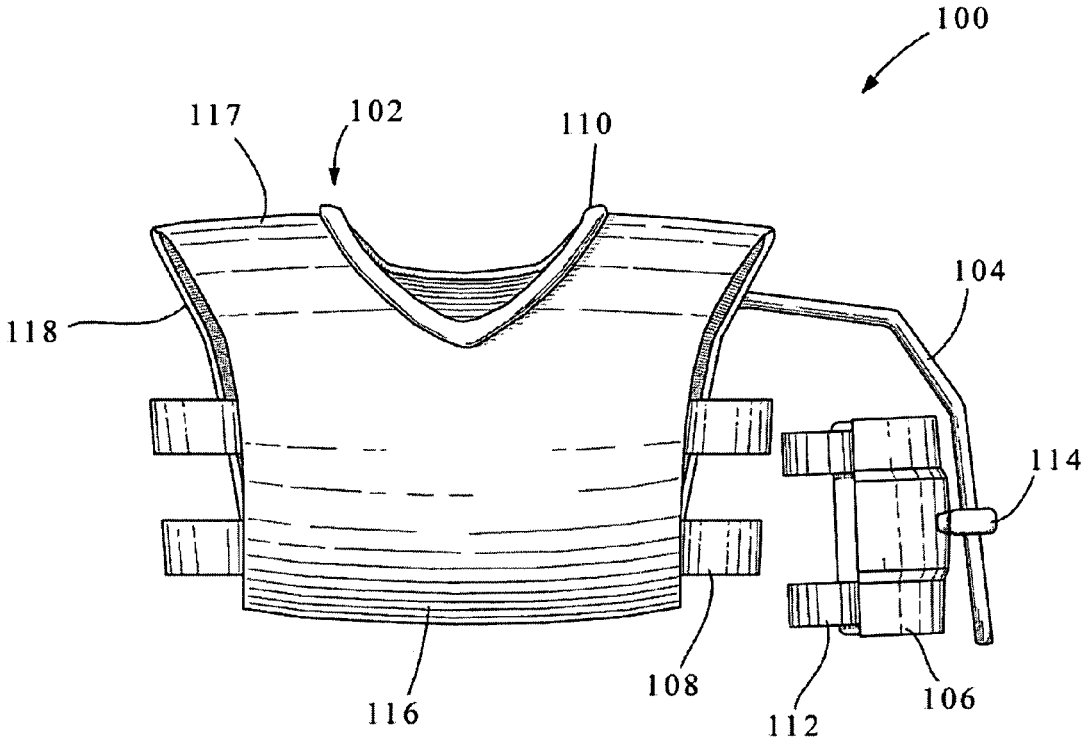
FIG. 1 is a front elevational view of a billiards stroke training device, in accordance with an embodiment of the invention.

FIG. 1 is a front elevational view of a billiards stroke training device, in accordance with an embodiment of the invention. In one embodiment, the billiards stroke training device 100 includes a harness 102, a post 104, a sleeve 106, harness straps 108, a harness collar 110, sleeve straps 112, and a guide 114. The harness 102 is coupled to the post 104 and the sleeve 106 is coupled to the guide 114. The post 104 extends laterally and downwardly from the harness 102 and is configurable to being removably and movably inserted through the guide 114.

In one embodiment, the harness 102 is constructed from a relatively rigid material and defines a harness front 116, a harness upper portion 117, and a harness back 118. The harness upper portion 117 defines an aperture rimmed by the harness collar 110. The harness straps 108 elastically traverse between the harness front 116 and the harness back 118 on opposing sides of the harness 102. Accordingly, the harness 102 is configurable to being worn by a billiards player (FIG. 3) with the player's head being inserted through the aperture of the harness upper portion 117, with the harness upper portion 117 resting on the player's shoulders, and with the harness front 116 and harness back 118 extending down the player's upper torso to a lower portion of the player's rib cage. The harness straps 118 are then used to adjustably secure the harness 102 to the player. The sleeve 106 is constructed from a relatively rigid material and defines a concave surface. The sleeve 106 includes the guide 114 on its outer surface and the sleeve straps 112 that elastically traverse between opposing edges of the sleeve 106. The sleeve 106 and the guide 114 are constructed from a single mold. Accordingly, the sleeve 106 is configurable to being worn by the billiards player (FIG. 3) with the sleeve 106 resting against player's arm, the sleeve straps 112 adjustably securing the sleeve 106 thereon, and the guide 114 protruding outwardly. The post 104 is constructed from a rigid material and is removably secured to the harness back 118. The post 104 extends from the harness 102 laterally and downwardly and is removably and movably inserted through the guide 114. Accordingly, when the harness 102 and the sleeve 106 are worn by a billiards player movement of the player's arm is limited to that provided for by the post 104 and the guide 114.

In various other embodiments, the harness 102 is wholly or partially constructed from less rigid or more flexible material. For example, the harness back 118 can be rigid while the harness upper portion 117 and the harness front 116 can be flexible. Also, the harness back 118, the harness upper portion 117, and the harness front 116 can be entirely flexible or constructed from elastic material. The harness 102 can be differently shaped. For example, the harness 102 can be separable on the harness front 116 with laces or straps to accommodate various player sizes. Also, the harness front 116 and the harness back 118 can be shorter or extend further down the player's torso. Alternatively, the harness front 116 can be connected to the harness back 118 in lieu of the harness straps 108. Further, the harness upper portion 117 and the harness collar 110 can be omitted with the harness front 116 and the harness back 118 being configured to circumscribe the player's upper torso. Also, the harness 102 can be supplemented or replaced with straps that circumscribe the player's upper torso, shoulders, neck, or arms. In yet further embodiments, the post 104 is constructed from any of metal, plastic, wood, synthetic material, a combination thereof, or any other material. The post 104 can be coupled to any portion of the harness 102 and can extend in any direction. For example, the post 104 can be coupled to the harness upper portion 117 or the harness front 116. Further, the post 104 can extend in an opposite direction than illustrated to accommodate player's being left or right handed or can extend upwardly such as when coupled to a lower portion of the harness 102. Also, the post 104 can be shaped differently, can include fewer or greater angles, or can include one or more adjustable articulable joints. Additionally, the post 104 can include a safety cap on either end to prevent bodily injury. Further, the post 104 can be supplemented with one or more additional posts. In other embodiments, the sleeve 106 is wholly or partially constructed from more or less rigid materials. For example, the sleeve 106 can be constructed from an elastic material. The sleeve 106 can be differently shaped; for example, the sleeve 106 can be flat, non-uniformly shaped, or can extend completely around the player's arm. In one particular embodiment, the sleeve 106 is coupled, removably coupled, or adjustably coupled to any portion of the harness 102 such as the harness upper portion 117. In yet further embodiments, the guide 114 is a separate component that is coupled or removably coupled to the sleeve 106. Also, the guide 114 can be disposed at any position relative to the sleeve 106 and its position can be adjustable. For example, the guide 114 can be adjustable up, down, in, out, rotationally, or angularly relative to the sleeve 106. Alternatively, the guide 114 is alternatively constructed as a plate or any other device that provides for constrained motion, such as by using a channel, rollers, or magnets. In yet other embodiments, the sleeve straps 112 and the harness straps 108 can be fewer or greater in number or can be omitted or supplemented with an alternative securing mechanism such as buckles, laces, belts, buttons, snaps, zippers, material, or stretchable material. The sleeve straps 112 and the harness straps 108 can be disposed at any position relative to the sleeve 106 and the harness 102, respectively.

Figure 2:
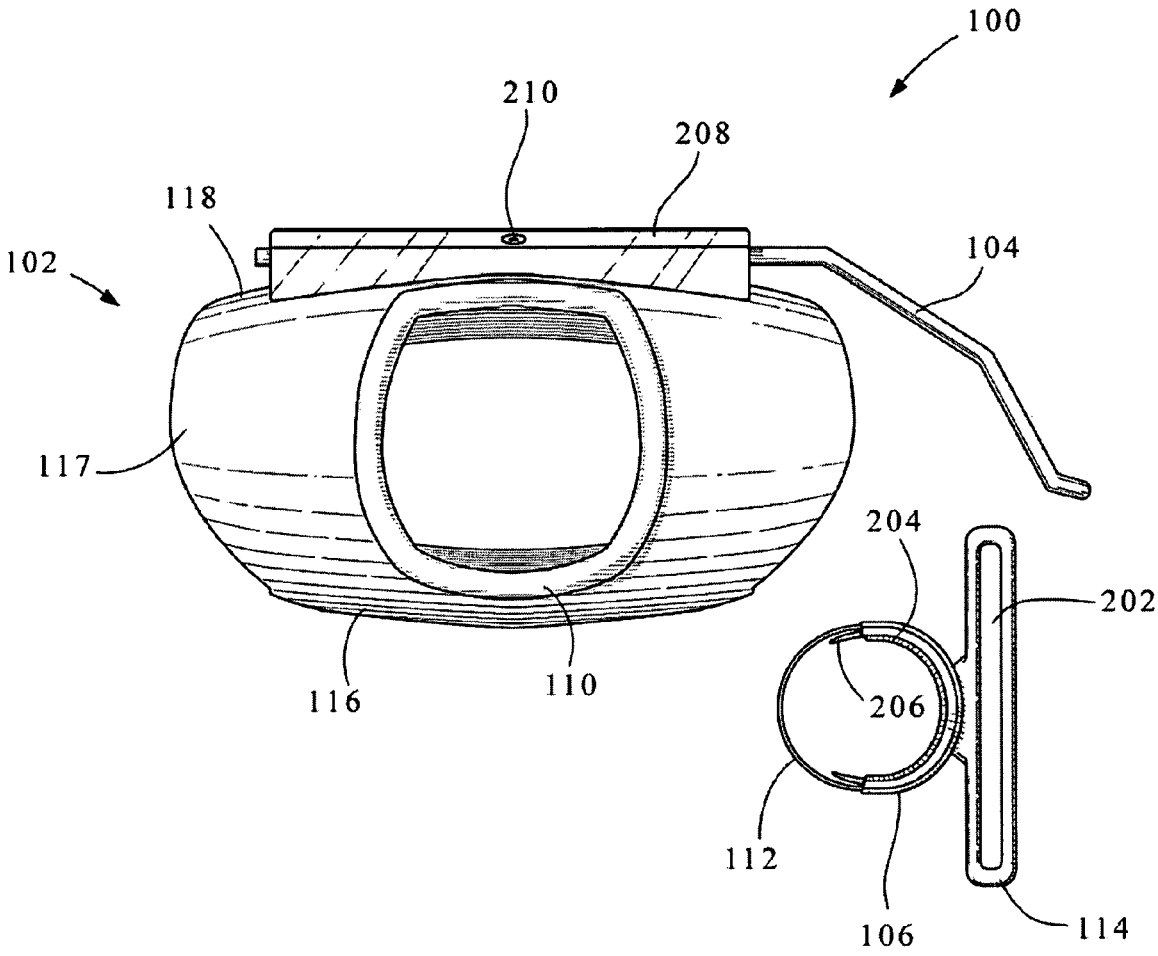
FIG. 2 is a top view of a billiards stroke training device, in accordance with an embodiment of the invention.

FIG. 2 is a top view of a billiards stroke training device, in accordance with an embodiment of the invention. In one embodiment, the billiards stroke training device 100 includes the harness 102 having the harness front 116, the harness upper portion 117, the harness back 118, and the harness collar 110; a post mount 208; the post 104; the sleeve 106 having the sleeve straps 112, sleeve padding 204, and sleeve flaps 206; and the guide 114 having a guide channel 202. As described in reference to FIG. 1 supra, the harness front 116 is coupled to the harness back 118 via the harness upper portion 117. The harness upper portion 117 defines an aperture that is rimmed by the harness collar 110. Accordingly, the harness 102 is shaped to be comfortably worn on the player's shoulders and upper torso. The post mount 208 is coupled to the harness back 118 and is configurable to removably secure the post 104 therein. The post 104 extends laterally and downwardly from the post mount 208 and is configurable to being removably and movably inserted through the guide channel 202 of the guide 114. The guide 114 extends from the sleeve 106, which includes the sleeve padding 204 on its inner surface and the sleeve straps 112. Accordingly, the sleeve 106 is configured to be comfortably worn on the player's arm with the sleeve straps 112 securing the sleeve 106 thereto and the sleeve flaps 206 preventing pinching.

Figure 3A:
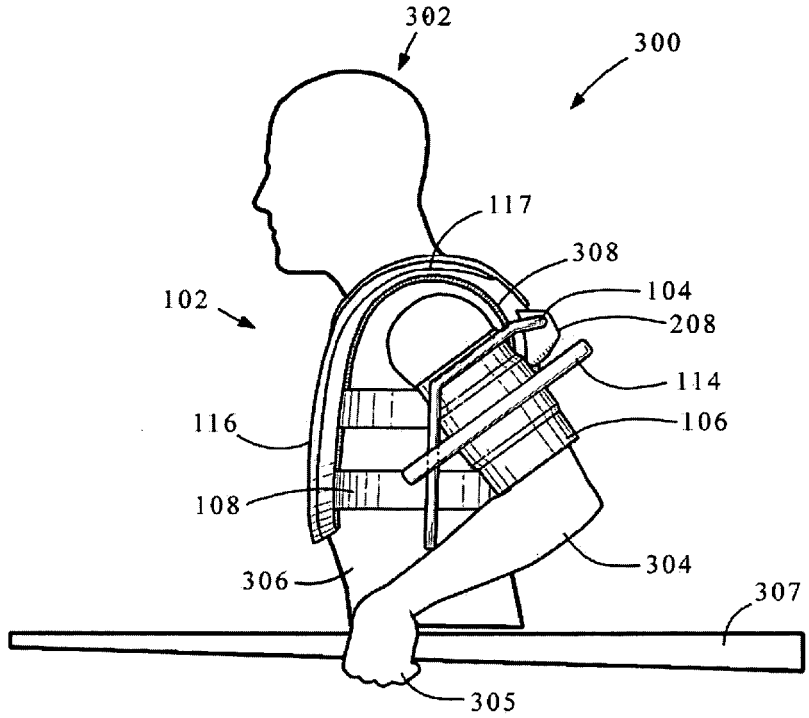
FIGS. 3*a* and 3*b* are a side elevational view of a billiards stroke training device worn by a billiards player, in accordance with an embodiment of the invention.
Figure 3B:
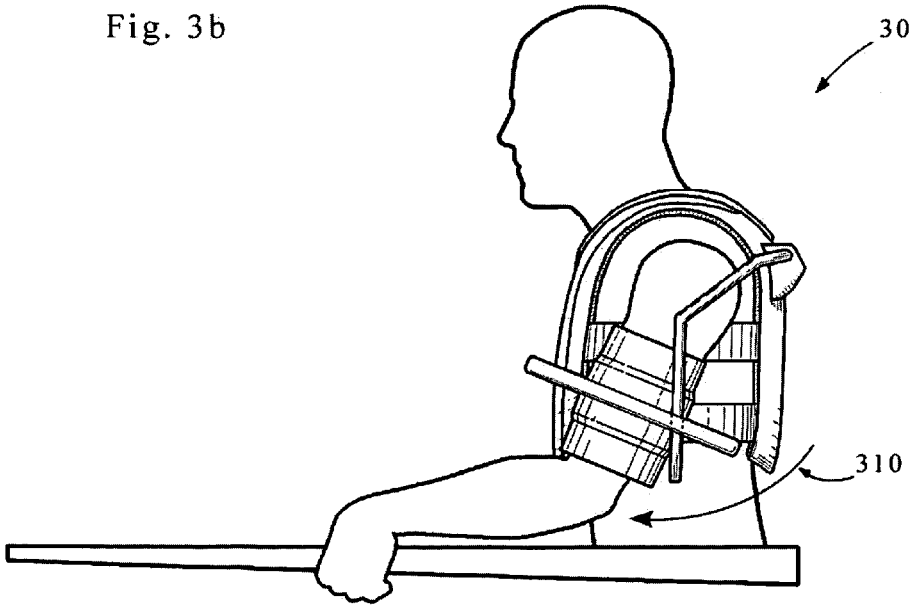

FIGS. 3*a* and 3*b* are a side elevational view of a billiards stroke training device worn by a billiards player, in accordance with an embodiment of the invention. In one embodiment, the billiards stroke training device worn by a billiards player 300 includes a billiards player 302 having a body 306, an arm 304, and a hand 305; the harness 102 having the harness front 116, the harness upper portion 117, the harness back 118, harness padding 308, and the harness straps 108; the post mount 208; the post 104; the guide 114; the sleeve 106; and a cue stick 307. As described in reference to FIGS. 1 and 2 supra, the harness 102 is worn by the billiards player 302 with the harness upper portion 117 resting on the shoulders of the billiards player 302 and the harness front 116 and the harness back 118 extending down the body 306 of the billiards player 302. The harness padding 308 lines an internal surface of the harness 102 and interfaces the harness 102 and the body 306 to provide a comfortable fit. The harness straps 108 extend between the harness front 116 and the harness back 118 under the arm 304 to secure the harness 102 to the body 306. The sleeve 106 is worn on the arm 304 of the billiards player 302 and is secured thereon using the sleeve straps 112 (not visible). The guide 114 extends from the sleeve 106 as is configurable to removably and movably receive the post 104 therein. The post 104 extends from the post mount 208 on the harness back 118 and extends laterally and downwardly through the guide channel 202 (not visible) of the guide 114. The hand 305 of the player 302 is configurable to gripping the cue stick 307. Accordingly, when the player 302 wears the harness 102 and the sleeve 106 as described, motion 310 of the arm 304, the hand 305, and the cue stick 307 is limited to that provided for by the post 104 as it moves through the guide channel 202 thereby providing a billiards stroke training device.

In certain embodiments, the post 104 or the guide 114 are differently shaped or positioned to provide the same or different limitations on the motion 310 such as to accommodate different billiards playing styles, different player sizes, or different player handedness. For example, the post 104 can extend more laterally to accommodate players having a more closed billiards stance. Further, either the shape or the position of the post 104 or the guide 114 can be adjustable. For example, the guide 114 can be extended, shortened, rotated, shifted, titled, or otherwise displaced. Similarly, the post 104 can be straightened, bent, extended, shortened, rotated, shifted, tilted, or otherwise displaced. The post 104 and the guide 114 can include articulable joints to facilitate any of the above. Furthermore, additional posts can be provided to supplement or interchange with the post 104 that embody different sizes, angles, lengths, materials, or other characteristics. In one particular embodiment, the harness padding 308 is wholly or partially omitted.

Figure 4:
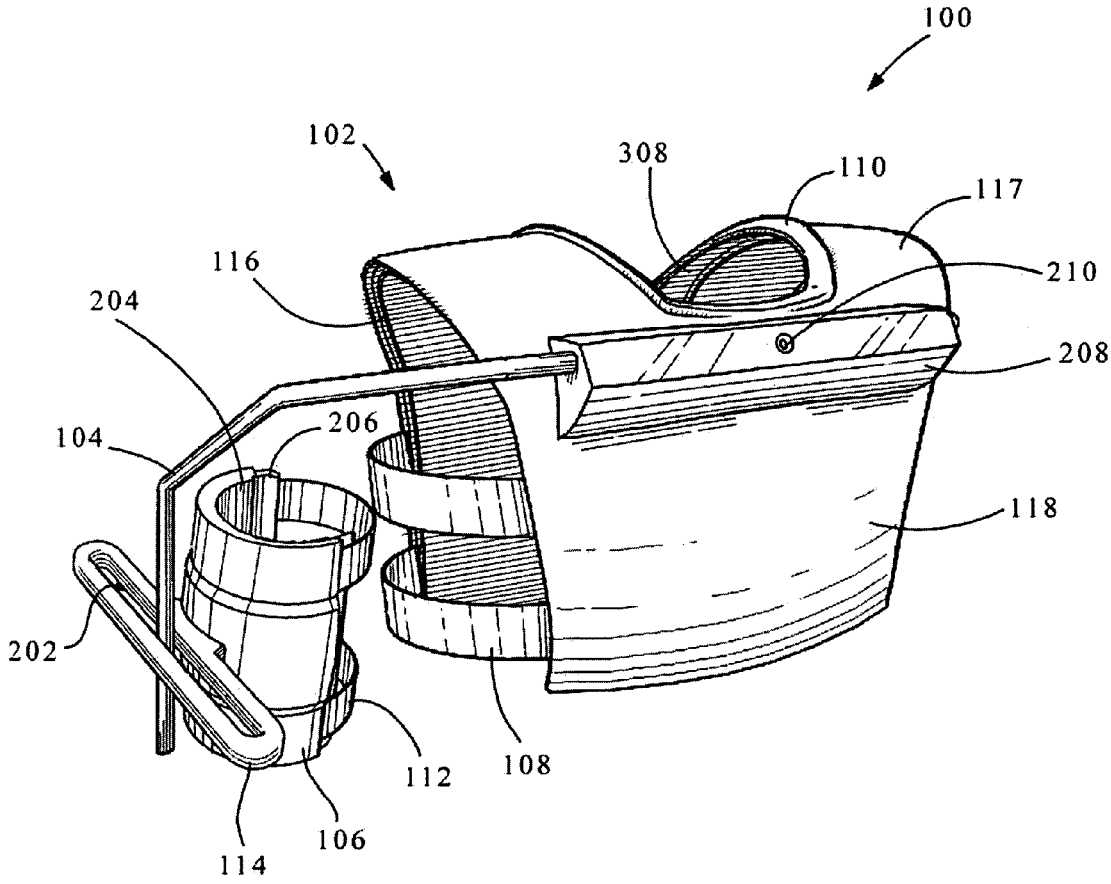
FIG. 4 is a back perspective view of a billiards stroke training device, in accordance with an embodiment of the invention.

FIG. 4 is a back perspective view of a billiards stroke training device, in accordance with an embodiment of the invention. In one embodiment, the billiards stroke training device 100 includes the harness 102 having the harness front 116, the harness upper portion 117, the harness back 118, the harness collar 110, the harness padding 308, and the harness straps 108; the post mount 208; the post 104; the guide 114 having the guide channel 202; and the sleeve 106 having the sleeve padding 204, the sleeve flaps 206, and the sleeve straps 112 as described more fully in reference to FIGS. 1-3 supra.

In one embodiment, the post mount 208 is constructed from a rigid material and extends lengthwise along the harness back 118 just beneath the harness collar 110. The post mount 208 defines an internal channel along its length for receiving the post 104 therein. The post 104 is insertable into the internal channel from either side of the post mount 208 to accommodate right and left handed players. Once inserted, the post mount 208 includes a locking mechanism such as a pin, bolt, bearing, magnet, bicycle seat-type mounting bracket, or some other device or system that secures the post 104 therein. The release button 210 is usable to release the post 104 from the post mount 208.

In one embodiment, the guide 114 is constructed from a rigid material and forms an elongated member that defines the guide channel 202 along its length. The guide channel 202 has a width sufficient to receive the post 104 therein whereby the post 104 is configurable to traversing a length of the guide 114 within the guide channel 202. The post 104 is otherwise unsecured to the guide channel 202.

In various embodiments, the post mount 208 is wholly or partially constructed from less rigid and more flexible materials. The post mount 208 can be differently shaped such as with two or more separate components and can be configured to removably secure the post 114 externally. The post mount 208 can be alternatively disposed at any position relative to the harness 102 including on the harness upper portion 117 or on the harness front 116 or can be integrated with the harness 102. The post mount 208 can be adjustable in any direction relative to the harness 102 including up, down, in, out, rotationally, or angularly. The post 104 can be mounted on a side of the post mount 208, directly to the harness 102, or can be an extension of the post mount 208 or the harness 102. The internal locking mechanism and the release button 210 can be omitted, supplemented, or replaced by any other means for removably securing the post 104 to the post mount 208. The post 104 can be irremovably fixed to the post mount 208. In yet further embodiments, the guide 114 is constructed wholly or partially from less rigid and more flexible materials. Also, the guide 114 can be alternatively shaped including circular, oval, or some other uniform or non-uniform shape. Further, the guide 114 can be alternatively positioned relative to the sleeve 106 or the harness 102. For example, the guide 114 can be coupled to the harness 102 and the post 104 can be secured to the sleeve 106. Further, the guide channel 202 can be widened, shortened, or alternatively shaped or can be replaced with any mechanism that permits movement of the post 104 relative to the guide 114 including rollers. Also, the guide channel 202 can be adjustable such as by width, length, or shape.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A device for billiards stroke training, the device comprising:

a harness to be worn by a billiards player;

an adjustable sleeve worn around an arm of the billiards player wearing the harness;

wherein the adjustable sleeve comprises a concave surface, sleeve straps, and sleeve flaps, wherein the sleeve straps are configured to adjustably secure the concave surface to the arm of the billiards player, and wherein the sleeve flaps are configured to interface between the sleeve straps and the arm of the billiards player to prevent pinching, a guide coupled to and protruding laterally outwardly from the adjustable sleeve, the guide including an elongated guide channel extending longitudinally along the length of the guide; and, a post coupled to the harness, the post extending laterally outwardly and downwardly from the harness and into the guide channel formed in the guide when the adjustable sleeve is worn around the arm of the billiards player, a post mount coupled to a backside of the harness, wherein the post is configured to be removably secured to the post mount on the harness and extending laterally outwardly and downwardly from the harness, the guide channel is of sufficient length so when the billiards player moves-his arm, the movement of the post within the guide channel is limited thereby controlling the movement of the arm of the billiards player in the fore and aft directions when performing a billiards stroke.

2. The device of claim 1 wherein the harness comprises a harness front, a harness upper portion, a harness back, and at least one harness strap, wherein the harness upper portion defines an aperture for receiving a head of the billiards player, and wherein the harness straps extend between the harness front and the harness back to adjustably secure the harness to the upper torso of the billiards player.

3. The device of claim 1 wherein the guide, the post, and the post mount are adjustable.

* * * * *